US006669900B2

(12) United States Patent
Matsunaga et al.

(10) Patent No.: US 6,669,900 B2
(45) Date of Patent: Dec. 30, 2003

(54) METHOD OF MANUFACTURING MAGNESIUM ALLOY MOLDED PRODUCT, PAINTED STRUCTURE THEREOF, METHOD OF PAINTING THE SAME, AND CASINGS USING THE SAME

(75) Inventors: Koji Matsunaga, Katano (JP); Yukio Nishikawa, Ikeda (JP); Naohiro Shikata, Osaka (JP); Mitsuharu Kamikawaji, Habikino (JP); Keizou Matsumura, Hirakata (JP); Akira Takara, Osaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 98 days.

(21) Appl. No.: 10/003,380

(22) Filed: Dec. 6, 2001

(65) Prior Publication Data

US 2002/0069940 A1 Jun. 13, 2002

(30) Foreign Application Priority Data

Dec. 7, 2000 (JP) ..... 2000-372186

(51) Int. Cl.[7] ..... C22C 1/02; C22C 23/02
(52) U.S. Cl. ..... 420/407; 428/689
(58) Field of Search ..... 428/689; 420/407

(56) References Cited

U.S. PATENT DOCUMENTS 5,372,181 A * 12/1994 Watanabe et al. ..... 164/457
6,316,129 B1 * 11/2001 Seki et al. ..... 428/687

FOREIGN PATENT DOCUMENTS

WO WO 00/70123 * 11/2000 ..... C23F/1/00

* cited by examiner

*Primary Examiner*—Daniel J. Jenkins
(74) *Attorney, Agent, or Firm*—Parkhurst & Wendel, L.L.P.

(57) ABSTRACT

There are provided a painted structure of a magnesium alloy molded product having an aesthetic appearance, a painting method of forming the patented structure of the magnesium alloy molded product having an aesthetic appearance, and a casing fabricated using the magnesium alloy molded product. The painted structure of the magnesium alloy molded product has flow marks of which maximum depth is 100 $\mu$m and maximum opening width is 0.5 mm. An anticorrosive film is formed on a surface of the magnesium alloy molded product, and a painted film having an average surface roughness of 10 $\mu$m or more and a thickness of 80 $\mu$m or more is formed on a surface of the anticorrosive film.

14 Claims, 6 Drawing Sheets

PRIORT ART

METHOD OF MANUFACTURING MAGNESIUM ALLOY MOLDED PRODUCT, PAINTED STRUCTURE THEREOF, METHOD OF PAINTING THE SAME, AND CASINGS USING THE SAME

FIELD OF THE INVENTION

The present invention relates to a method of manufacturing a magnesium alloy molded product, a painted structure thereof, a method of painting the same, and casings using the same.

BACKGROUND OF THE INVENTION

In recent years, magnesium alloys have attracted public attention for their ease of recycling, low specific gravities, and good heat dissipating properties. As the products using magnesium alloys, the casings for household electrical appliances, such as television receivers, notebook-type personal computers, and portable minidisk players, or wheels of vehicles have been practically used. Magnesium alloys used in these products are mainly of AZ91 series for casting and AD31 series for sheet metal processing, and most of these are materials for casting, which are formed into molded products by the die-casting method or the thixo molding method.

On the surface of a metal molded product such as a magnesium alloy molded product, an anticorrosive film is normally formed for preventing the occurrence of rust, as well as providing an aesthetic appearance. Since flow marks produced during molding, or voids in which gas is trapped are present in the surface of magnesium alloy molded products, putty as well as layers of painting are applied to the surface of the molded products in order to hide flow marks and to prevent the gas trapped in voids from expanding and foaming.

For example, painting of middle to large size molded products, such as the housings of television receivers and notebook-type personal computers comprising a step (S1) of forming an anticorrosive film on the surface of a molded product; and a step (S2) of forming a painted film on the surface of the anticorrosive film. In the anticorrosive-film forming step (S1), dewaxing (S1-1) and activation (S1-2) are performed, and an anticorrosive film is formed (S1-3). Next, in the painted film forming step (S2), a primer is applied onto the surface of the anticorrosive film to form a painted film (S2-1), which is baked for curing (S2-2), then putty is applied (S2-3), the putty is baked for curing (S2-4), the putty overflown around the molded product is removed (S2-5), a primer is further applied (S2-6), and this primer is baked for curing (S2-7). Finally, top coating is applied (S2-8), and this is baked for curing (S2-9). This application of top coating is repeated twice or more as required.

In such conventional painting methods, however, a large number of process steps are required, and because of putty applying, the painting process is interrupted, and it is impossible to process the parts continuously. Therefore, there are problems that the efficiency of processing is limited, and the processing costs are high.

Therefore, the object of the present invention is to provide a painted structure of a magnesium alloy molded product having an aesthetic appearance, a method of manufacturing a molded product that can obtain a painted structure of a magnesium alloy molded product having an aesthetic appearance in a few process steps, a method of painting such a molded product, and a casing using such a molded product.

DISCLOSURE OF THE INVENTION

The present inventors paid attention to the fact that application of putty in a process of forming a painted film was the largest cause that complicated the coating step, that is, the number of process steps was increased and the processes could not be performed continuously. The inventors have devised to omit the application of putty, and to form the painted film by a single application of a powder paint and a single baking-for-curing treatment. As a result of studying the appearance of a magnesium alloy molded product completed in this painting process from various view points, it was known that an aesthetic appearance can be secured by setting the thickness of a painted film to a certain ratio or more relative to flow marks normally appearing in a magnesium alloy molded product, and by specifying the surface roughness of the molded product, such that flow marks can be sufficiently hidden in a single layer painted film in which application of putty is omitted.

A painted structure of a magnesium alloy molded product of the present invention comprises at least a magnesium alloy molded product having flow marks of a depth D, and a painted film of a thickness T formed on a surface of the magnesium alloy molded product, wherein the thickness of the painted film is 80% or more of the depth of the flow marks. Here, the thickness of the molded product is 0.3 mm to 5.0 mm. Also, the painted film contains no putty-filled regions.

Further, the painted structure of a magnesium alloy molded product has flow marks of which maximum depth is 100 $\mu$m and maximum opening width is 0.5 mm, wherein an anticorrosive film is formed on the surface of the magnesium alloy molded product, and a painted film having an average surface roughness of 10 $\mu$m or more and a thickness of 80 $\mu$m or more is formed on the surface of the anticorrosive film.

According to this configuration, since the painted film having an average surface roughness of 10 $\mu$m or more has been formed on the surface of the magnesium alloy molded product having flow marks as described above, light beams radiated onto the surface of the painted film can be irregularly reflected. Also, since the painted film has a thickness of 80 $\mu$m or more, it is enough to hide flow marks in cooperation with the irregular reflection. Therefore, a single layer of the painted film can hide flow marks, securing an aesthetic appearance without using putty as in conventional methods. Further, the anticorrosive film prevents occurrence of rust on the molded product.

When the painted film has an average roughness of less than 10 $\mu$m and a thickness of less than 80 $\mu$m, flow marks may be insufficiently hidden in a magnesium alloy molded product having flow marks of which maximum depth is 100 $\mu$m and of which maximum opening width is 0.5 mm.

In the painted structure according to the present invention, the painted film may be formed from a powder paint. According to this configuration, the particles of the powder paint ensure the average surface roughness of the painted film.

Also, in the painted structure according to the present invention, the painted film may contain an aluminum powder. According to this, the irregular reflection on the surface of the painted film is promoted by the aluminum powder.

Also, in the painted structure according to the present invention, the painted film may be formed from the film of the oxide of magnesium constituting the magnesium alloy molded product. According to this configuration, the magnesium oxide film prevents the occurrence of rust on the molded product, and ensured the adhesion of the painted film.

Furthermore, a method of manufacturing a magnesium alloy molded product according to the present invention comprises the steps of: melting all or a part of a magnesium-aluminum alloy containing 4 to 12% aluminum; heating a mold to which a release agent is applied to a temperature between 200° C. and 300° C.; injection-molding the magnesium alloy; and removing flow parts other than the product part from the obtained molded body. The thickness of the molded product is 0.3 mm to 5.0 mm.

According to this manufacturing method, a molded product that can hide flow marks with the painted film can be obtained, and such a thickness of the molded can be ensured that gives a large hiding effect.

Furthermore, the method of painting a magnesium alloy molded product according to the present invention comprises the steps of: forming an anticorrosive film on the surface of a magnesium alloy molded product; applying a powder paint on the surface of the anticorrosive film, a curing start temperature of which powder paint is 140° C. or lower; and bake-curing the applied powder paint.

According to the above-described configuration, since the powder paint is applied, the curing-start temperature of which powder paint is 140° C. or lower, in the step of base-curing the powder paint, the power paint is cured while it is not completely melted and remains as particles on the painted film. As a result, a painted film having a large average surface roughness can be formed. Also, since the powder paint has a low curing-start temperature, the powder paint is cured to form a painted film at a temperature lower than a temperature at which a gas trapped in voids expands and foams, so that the gas is prevented from foaming from the voids, and fine holes such as pinholes are hardly formed on the painted film. Moreover, since a painted film having a large average surface roughness can be formed, the painted film hides flow marks present on the surface of the molded product, and the appearance of the molded product can be improved without using putty. Therefore, painted structures having an aesthetic appearance can be obtained continuously, with improved treatment efficiency and at low costs.

If the curing-start temperature of the powder paint exceeds 140° C., since the quantity of the powder paint that remains as particles decreases, the painted film having a large average surface roughness can be hardly formed. Also, since the powder paint cures at a relatively high temperature to form a painted film, it becomes difficult to prevent a gas from foaming from voids.

Furthermore, according to the method of painting the magnesium alloy molded product of the present invention, it is possible to continuously obtain painted structures having an aesthetic appearance, to improve treatment efficiency, and to realize low costs.

Also, according to the method of painting the magnesium alloy molded product of the present invention, an anticorrosive film composed of an oxide film integral with the surface of the molded product can be formed thereon.

In the method of painting the magnesium alloy molded product of the present invention, the step of forming the anticorrosive film in the above-described constitution comprises a dewaxing process, an activating process, and an oxide-film forming process. According this configuration, the surface of the molded product is cleaned and activated, and an anticorrosive film composed of an oxide film integral with the surface of the molded product is formed thereon with ease.

In the painting method of the present invention, an anticorrosive film is formed by a treatment using a phosphate in the above-described constitution. According this configuration, an anticorrosive film composed of an oxide film of magnesium formed from a phosphate and magnesium constituting the magnesium alloy molded product can be formed with ease.

Further, in the painting method of the present invention, a powder paint containing 3% by mass or more aluminum powder is applied onto the surface of the anticorrosive film in the above-described constitution. According this configuration, an enough quantity of aluminum powder is applied to the surface of the painted film to promote irregular reflection. If the quantity of aluminum powder contained in the powder paint is less than 3% by mass, the quantity of aluminum powder contained in the painted film may be too small to sufficiently promote irregular reflection.

Furthermore, a casing fabricated using the magnesium alloy molded product of the present invention has the above-described painted structure. According this configuration, flow marks are hidden, and an aesthetic appearance can be obtained.

DESCRIPTION OF THE EMBODIMENTS

Figure 1:
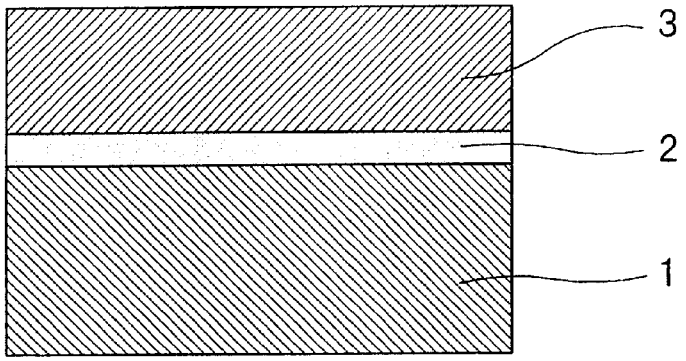
FIG. 1 is a sectional view showing a painted structure of a magnesium alloy molded product according to the present invention.

An embodiment of the present invention will be described below referring to the drawings.

As shown in FIG. 1, the painted structure of a magnesium alloy molded product according the present invention comprised of an anticorrosive film 2 formed on the surface of a magnesium alloy molded product 1, and a painted film 3 formed thereon.

The molded product 1 is molded by thixo molding or die-casting, and there are flow marks and voids on the surface of the molded product 1. The maximum depth of the flow marks is 100 $\mu$m, and the maximum width of openings is 0.5 mm. The anticorrosive film 2 is formed for example from an oxide film, which is a reaction product of magnesium and a phosphate composing the magnesium alloy molded product. Furthermore, the painted film 3 is formed of a powder paint so as to have a predetermined thickness of 80 $\mu$m or more, and an average surface roughness of the surface of 10 $\mu$m or more.

Figure 2:
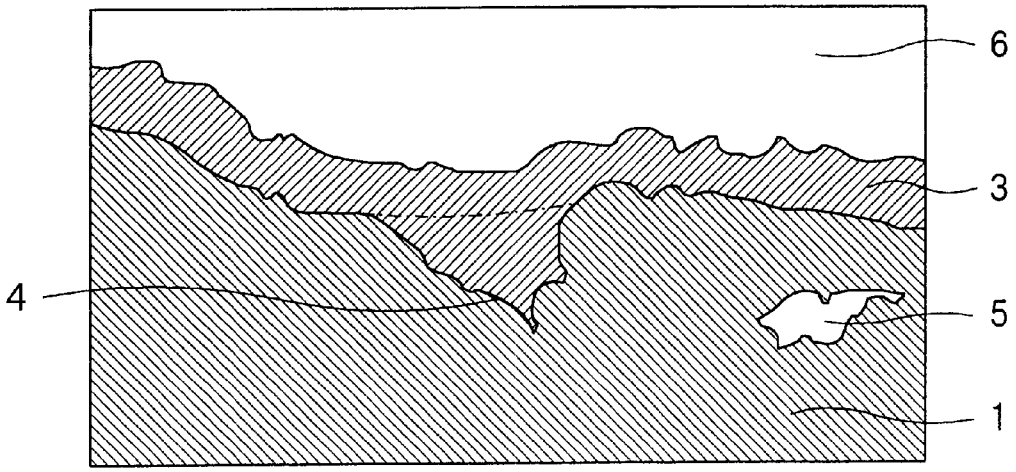
FIG. 2 is a schematic diagram of a sectional photography of a painted structure of a magnesium alloy molded product.

Although flow marks are present on the surface of the molded product 1, as described above, for example as shown in the schematic diagram of a sectional photography shown in FIG. 2, the flow marks 4 have a certain depth from the surface of the molded product 1, and when a painted film 3 of a powder paint is formed on the surface of the molded product 1, the flow marks 4 are filled with a part of the powder paint.

In FIG. 2, reference numeral 5 denotes a void, and reference numeral 6 denotes a resin layer used to fix the sample for photographing the cross section.

Figure 3:
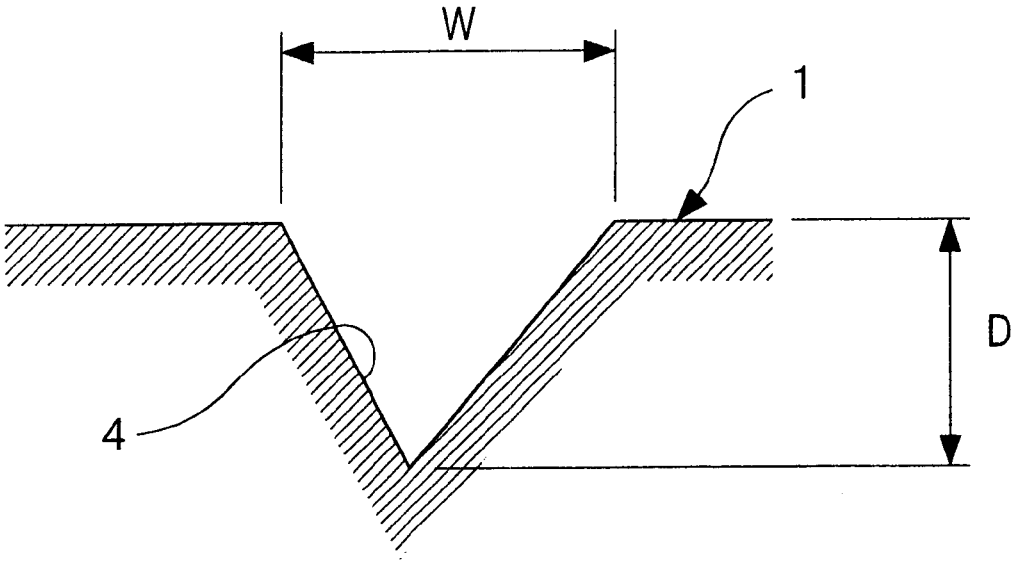
FIG. 3 is a diagram illustrating a depth and an opening width of a flow mark.

Here, in FIG. 3, the depth of flow marks means the depth D from the surface of the molded product 1, and the opening width of flow marks means the length W of the longest part of the openings of flow marks on the surface of the molded product 1.

Figure 4A:
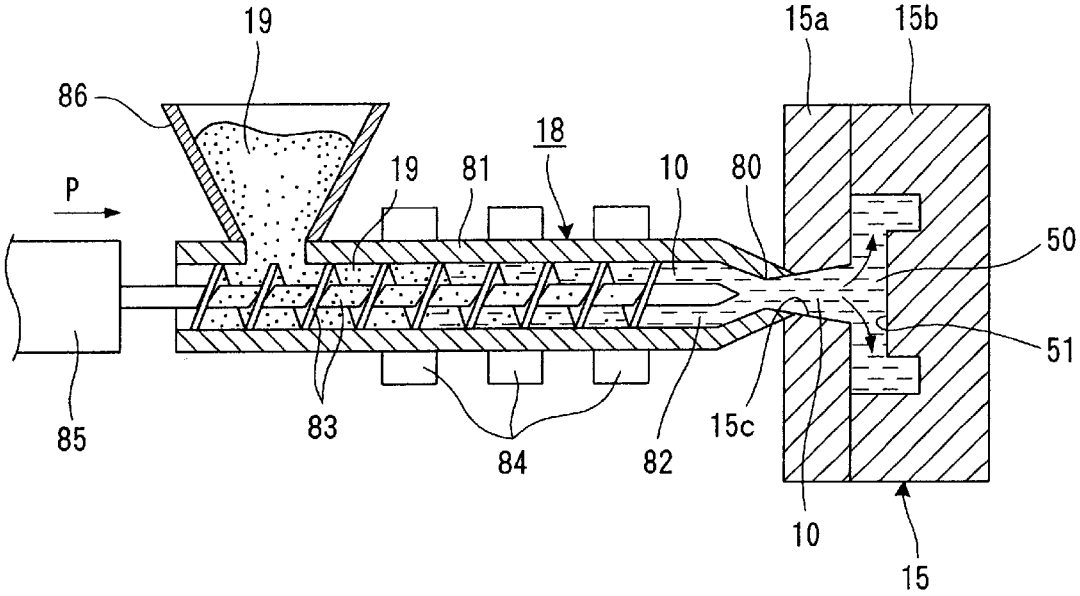
FIG. 4A is a sectional view schematically showing an injection process of an injection-molding machine.

The method of manufacturing a magnesium alloy molded product according to the embodiment of the present invention comprises a melting step and an injecting step, and a conventional injection-molding machine may be used for this purpose. As exemplified in FIG. 4A, an injection-molding machine comprises an extruding unit 18 (screw extruder in this example) to melt and mix a starting material of the alloy and to discharge the molten material at a high pressure, and a mold 15 (15*a*, 15*b*) connected to the discharging nozzle 80 of the extruding unit 18 and having a cavity 50 of a desired shape, which can be split so as to be able to take out the molded product.

More specifically, injection molding is performed in the following procedures. For explanation, an alloy including 9% (by weight, also in the following description) Al, about 1% other impurities, and Mg for the balance (liquid phase line temperature: about 530° C.) is selected. The alloy chips of this composition are charged in the hopper 86 of the extruding unit 18, transferred into the cylinder 81 of the extruding unit 18 by the screw 83, and maintained in the molten state at a temperature slightly higher than the liquid phase line temperature (about 550° C. for the above-described 9% Al alloy) in the cylinder 81 by heating of the heater 84 of the cylinder 81.

The mold 15 for injection molding is normally made of steel, and split mold (15*a*, 15*b*) having a cavity 50 of a desired shape of the molded product formed on the internal surface 51 thereof is used.

The cooling rate of the casting process by injection can be adjusted by the width of the cavity 50 as well as the mold temperature before injection, and the cooling rate may be lowered appropriately by warming the mold. It is preferable to preheat the mold 15 to the range between 200° C. and 300° C. for improving the flow characteristics of the melt.

In an example of the injection molding operation, split molds are assembled into the mold 15; the discharging nozzle of the screw extruding unit 18 is pushed and connected to the injecting port of the mold 15; the screw 83 is rotated while retracting in the cylinder 81 to transfer the molten metal 10 of which temperature is maintained as described above to the front portion of the cylinder 81 and to form a melt pool 82; and the molten metal 10 is injected at a high speed into the cavity 50 of the mold 15. The molten metal 10 that is being fed in the cavity 50 by injection contacts the internal surface 51 of the cavity 50 sequentially and cooled, and solidification proceeds in the above-described process in the flowing state. The screw 83 is pushed by the pressurizing means 85 to pressurize the molten metal 10, and the molten metal 10 is pushed against the internal surface 51 of the cavity 50 while supplementing shrinkage due to solidification to secure the cooling rate until the completion of solidification. Next, after the completion of solidification, the mold 15 is split, and the molded product 1 is taken out.

Figure 4B:
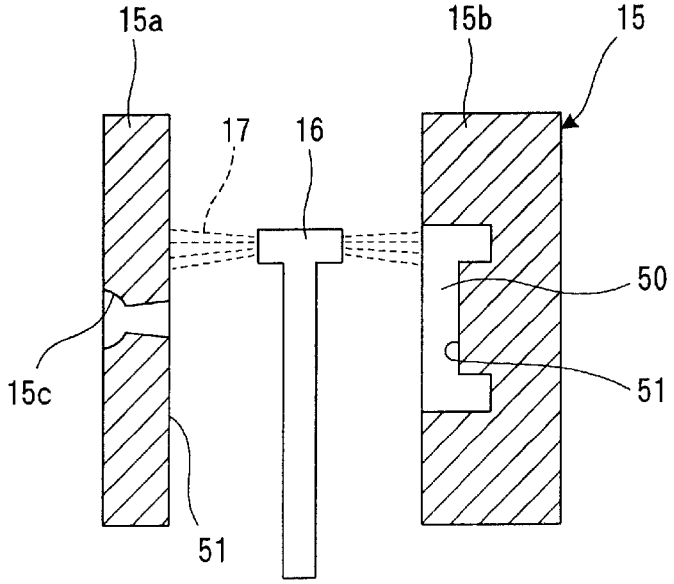
FIG. 4B is a diagram illustrating a process for applying a release agent.
Figure 5:
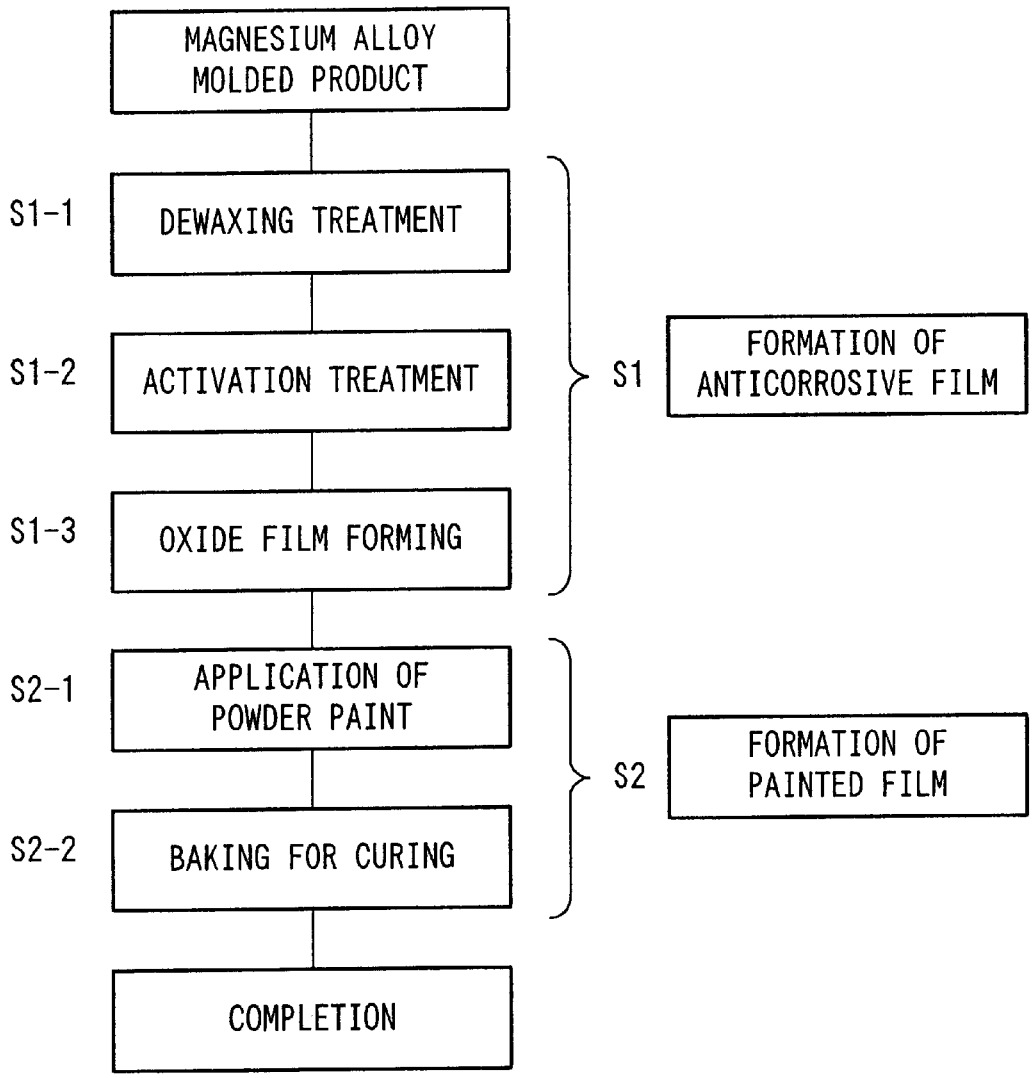
FIG. 5 is a flowchart showing a manufacturing process according to the present invention.

A release agent 17 is also previously applied onto the internal surface 51 of the cavity 50 of the mold 15. As the release agent 17, for example, a waxy mixture of fatty acid esters, and normally a liquid release agent 17 is sprayed onto the internal surface 51 of the cavity 50 of the mold 15 from the spray nozzle 16 as FIG. 4B shows to form a release agent film 17 of a thickness of about 100 $\mu$m after drying. The use of the release agent 17 prevents the molded product 1 from sticking to the mold 15, and facilitates the separation of the molded product 1 from the mold 15. When the release agent 17 is used, it is preferable for forming the painted film described below to remove the release agent 17 from the injected molded product 1 by dewaxing using a dewaxing solution, applying chemical treatment or blasting, or surface-polishing.

Since the molded product 1 is taken out of the mold 15 together with flow parts such as sprues, runners, and melt pools, these are separated from the product by pressing or cutting, and the molded product 1 is painted in the subsequent process.

The method of painting according to the present invention comprises: a step (S1) of forming an anticorrosive film 2 on the surface of the magnesium alloy molded product 1; and a step (S2) of forming a painted film 3 on the surface of the anticorrosive film 2.

The step (S1) of forming an anticorrosive film 2 comprises: a step (S1-1) of dewaxing the surface of the magnesium alloy molded product 1 by treating with an alkali solution or the like; a step (S1-2) of activating the cleansed surface of the molded product 1 by etching with an acid or the like; and a step (S1-3) of forming an oxide film such as a magnesium phosphate film by treating the activated surface of the molded product 1 with a phosphate or the like to allow phosphoric acid to react with magnesium composing the molded product 1.

The step (S2) of forming a painted film 3 comprises a step (S2-1) of applying a powder paint on the surface of the molded product 1 on which the oxide film 3 has been formed; and a step (S2-2) of baking for curing the applied powder paint. In the step (S2-1) of applying a powder paint, a powder paint of which the curing-start temperature is 140° C. or lower is applied to the surface of the molded product 1; and in the step (S2-2) of baking for curing the applied powder paint, the powder paint is cured during the time to elevate the temperature to a predetermined baking-for-curing temperature, and the powder paint remains as particles, thereby forming a painted film 3 having a surface roughness of 10 $\mu$m or more.

Embodiment

The manufacturing method according to the present invention will be described specifically below referring to an embodiment.

AZ91D magnesium alloy was molded into a primary molded product using a thixo molding machine from The Japan Steel Works, Ltd. The primary molding was subjected to secondary processes such as gate cutting and flash removing to obtain a molded product 1 for a television housing. The molded product 1 had a maximum opening width of flow marks of 0.5 mm, and a maximum depth of the melt waves of 100 $\mu$m.

As the surface treatment, the surface of the molded product 1 was cleaned with an alkali solution, and activated by etching with an acid. Then, the surface of the activated molded product was treated with a phosphate to form an anticorrosive film 2 composed of a magnesium phosphate film.

Next, as the powder paint, a powdered epoxy resin containing 3 to 7% by mass of aluminum power, and of which the curing-start temperature is 135° C. was applied onto the surface of the molded product 1 using a corona discharge gun. Thereafter, the coated molded product 1 was placed in a baking furnace of which temperature was elevated to 180 to 200° C., and was baked in this atmosphere for about 25 minutes to cure the powder paint on the surface of the anticorrosive film 2 to form a painted film 3, thereby obtaining the molded product 1 on which the painted film 3 was formed. Thus formed painted film 3 had a thickness of 100 to 120 μm, and an average surface roughness of 17 μm.

Figure 6:
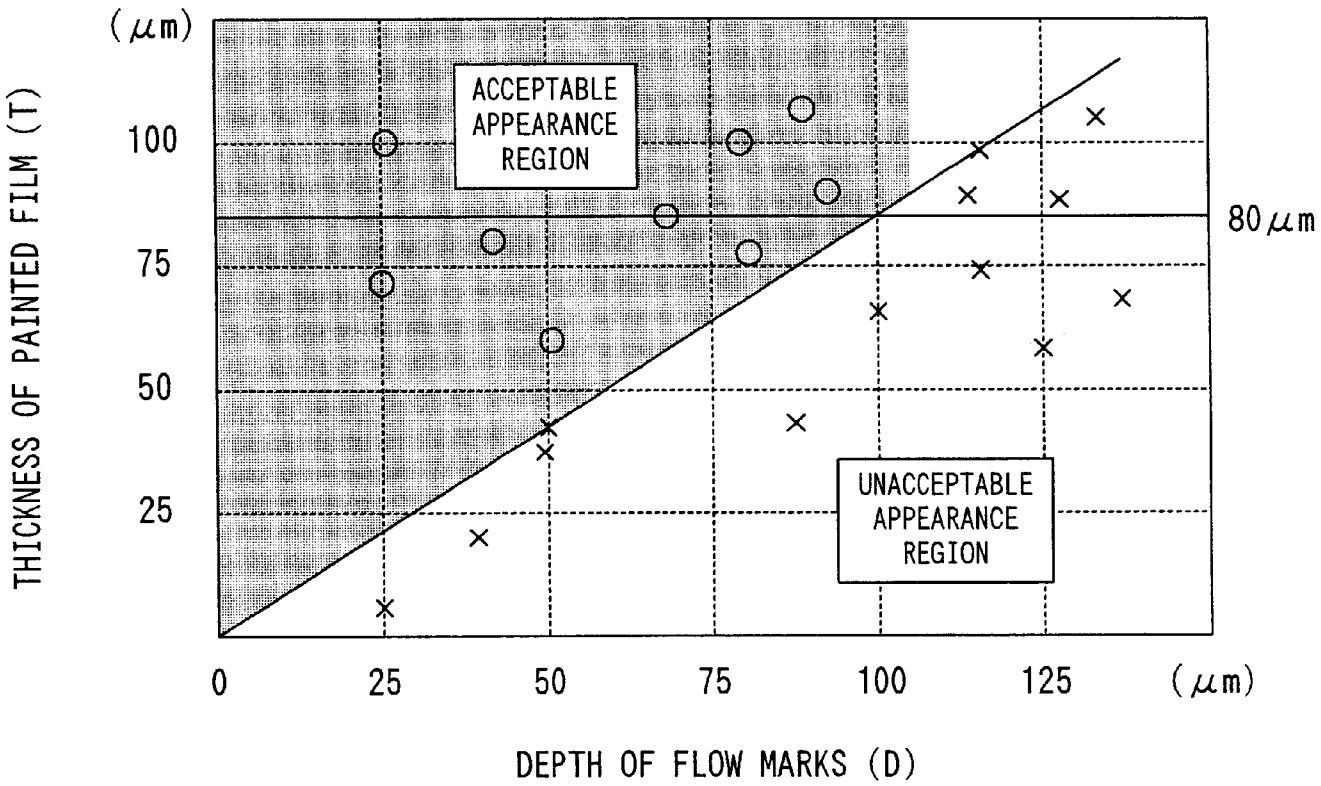
FIG. 6 is a graph showing a relationship between the depth of flow marks and a hiding power of painted films.
Figure 7:
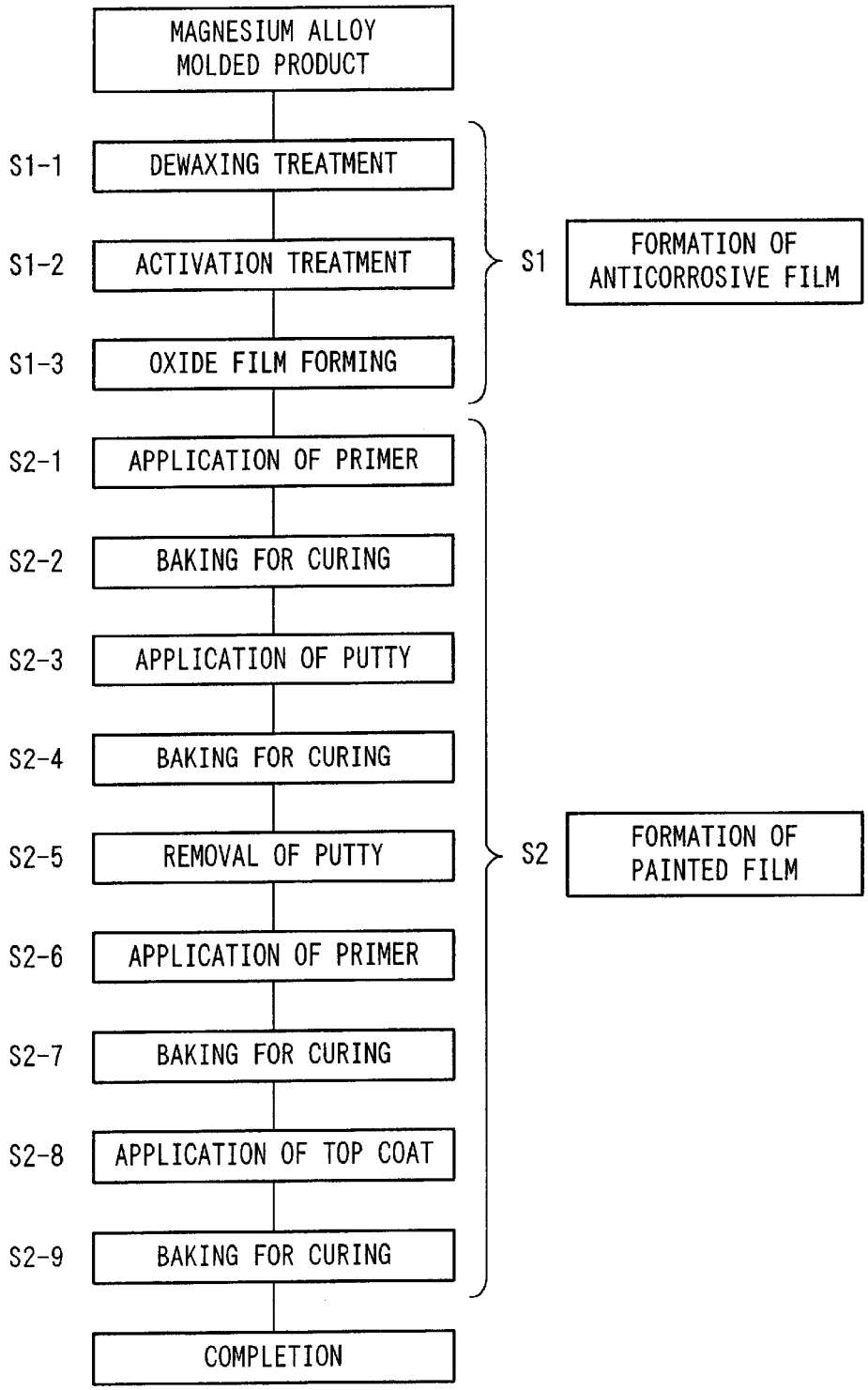
FIG. 7 is a flowchart showing a conventional manufacturing process.

The relationship between the thickness of the painted film 3, the depth of the flow marks, and the hiding power is shown in FIG. 6. As seen in FIG. 6 for various magnesium casings, for example, when the thickness of the painted film 3 is 80 μm or more, the molded product having flow marks of the maximum depth of 100 μm had a favorable appearance (acceptable appearance region). If the maximum depth of flow marks exceeded 105 μm, the appearance was poor (rejected appearance region).

Therefore, it is known that the flow marks are hidden, and the molded product having a maximum depth of flow marks of 100 μm and a maximum opening width of 0.5 mm is known to have a favorable appearance. At this time, the conditions related to the depth D of the flow marks and the thickness T of the painted film 3 to obtain sufficient hiding power is known to be $T \geqq 0.8D$. This relationship was obtained for various molded products having thickness of 0.3 to 5.0 mm.

Although the above-described molded product 1 having the painted film 3 was undergone three cycles of the saline spray tests, no peeling off of the painted film 3 nor development of corrosion were observed.

In the above-described embodiment, although a corona discharge gun was used for applying the powder paint, a tribo-gun may be used as the coating machine. Since the charge polarities of powder paint differ between a corona discharge gun and a tribo-gun, the suitable powder paint must be selected depending on the coating machine used. As the coating machine for powder paint, a flow immersion type machine may also be used.

What is claimed is:

1. A painted structure of a magnesium alloy molded product, comprising at least:

a magnesium alloy molded product having flow marks of a depth D that is greater than zero; and a painted film of a thickness T that is greater than zero formed on a surface of said magnesium alloy molded product, wherein a relationship between the depth of the flow marks and the thickness of the painted film is $T \geqq 0.8D$.

2. The painted structure of a magnesium alloy molded product according to claim 1, wherein a thickness of said molded product is 0.3 mm to 5.0 mm.

3. The painted structure of a magnesium alloy molded product according to claim 1, comprising:

the magnesium alloy molded product;

an anticorrosive film formed on the surface of said magnesium alloy molded product; and the painted film formed over said anticorrosive film, wherein said painted film contains no putty-filled regions.

4. A painted structure of a magnesium alloy molded product, having flow marks with a depth greater than zero and a maximum depth of 100 μm and a maximum opening width of 0.5 mm, wherein an anticorrosive film is formed on a surface of said magnesium alloy molded product, and a painted film having an average surface roughness of 10 μm or more and a thickness of 80 μm or more is formed on a surface of said anticorrosive film.

5. The painted structure of a magnesium alloy molded product according to claim 1, wherein said painted film is comprised of a powder paint.

6. The painted structure of a magnesium alloy molded product according to claim 1, wherein said painted film contains an aluminum powder.

7. The painted structure of a magnesium alloy molded product according to claim 1, wherein said anticorrosive film is formed from an oxide film of magnesium that composes the magnesium alloy molded product.

8. A method of manufacturing a magnesium alloy molded product, comprising the steps of:

melting all or a part of a magnesium-aluminum alloy containing 4 to 12% aluminum;

applying a release agent on a surface of a mold;

injecting a melt of said magnesium alloy into a mold cavity heated to a predetermined temperature between 200° C. and 300° C. to form a molded body; and removing flow parts such as sprue, runner and melt basin from a product part of said molded body taken out of the mold.

9. The method of manufacturing a magnesium alloy molded product according to claim 8, wherein said molded product has a thickness of 0.3 mm to 5.0 mm.

10. A method of painting a magnesium alloy molded product, comprising the steps of:

forming an anticorrosive film on a surface of a magnesium alloy molded product having flow marks with a depth greater than zero and a maximum depth is 100 μm and maximum opening width of 0.5 mm;

applying a powder paint on a surface of the anticorrosive film, said powder paint having a curing-start temperature of 140° C. or lower; and curing and baking the powder paint that has been applied.

11. The method of painting a magnesium alloy molded product according to claim 10, wherein said step of forming said anticorrosive film further comprises:

a dewaxing step;

an activation step; and an oxide-film forming step.

12. The method of painting a magnesium alloy molded product according to claim 10, wherein said anticorrosive film is formed by a treatment using a phosphate.

13. The method of painting a magnesium alloy molded product according to claim 10, wherein the surface of said anticorrosive film is applied with the powder paint containing an aluminum power of 3% by mass or more.

14. A casing fabricated using a magnesium alloy molded product having the painted structure according to claim 1.

* * * * *